United States Patent [19]

Bellis et al.

[11] Patent Number: 4,883,558

[45] Date of Patent: Nov. 28, 1989

[54] METHOD AND APPARATUS FOR BONDING PAIRS OF MOLD SHELLS INTO MOLDS

[75] Inventors: Kenneth E. Bellis, Rochester; Jackson E. Brown, Mt. Clemens; Pheroze J. Nagarwalla, Rochester Hills, all of Mich.; William Niedermeyer, Willowick; Paul Pawlak, Mentor, both of Ohio

[73] Assignee: Roberts Corporation, Lansing, Mich.

[21] Appl. No.: 248,513

[22] Filed: Sep. 23, 1988

[51] Int. Cl.[4] ..... B32B 31/00

[52] U.S. Cl. ..... 156/292; 118/501; 118/504; 156/556; 156/578; 164/339

[58] Field of Search ..... 156/556–559, 156/292, 578; 164/137, 168, 339; 29/784–789, 792; 118/301, 501, 504

[56] References Cited

U.S. PATENT DOCUMENTS

| | | | |
|---|---|---|---|
| 2,756,473 | 7/1956 | Anderson et al. | 164/339 |
| 3,039,157 | 6/1962 | Bobenmyer | 164/339 |
| 3,339,626 | 9/1967 | Buhrer et al. | 164/339 |
| 3,384,529 | 5/1968 | Kerr et al. | 156/556 |
| 4,572,762 | 2/1986 | Winston | 156/556 |
| 4,744,853 | 5/1988 | Landica et al. | 156/558 |

OTHER PUBLICATIONS

Shalco Binding Machines & Liquid Applicators, Bulletin SBM.

*Primary Examiner*—David Simmons
*Attorney, Agent, or Firm*—Thomas K. Ziegler; Raymond J. Eifler

[57] ABSTRACT

Apparatus (20) for bonding a pair of molds shells (28*a*, 28*b*) into a mold includes a first workstation (24) for applying adhesive to one of the shells (28*b*), and a second workstation (26) having a press (104, 106, 108) for pressing together the shells (28*a*, 28*b*) after adhesive has been applied thereto. A base (42) includes a pair of spaced apart base portions (42*a*, 42*b*) which are pivotally mounted so as to alternately rotate between the first and second workstations (24, 26). The first workstation (24) includes an adhesive applicator (58) carried on a carriage (88) which is slidably mounted on guiderails (94) so as to shift to a standby position providing access to a mold shell (28*b*) located on a base portion (42*a*) so as to allow the shells to be loaded and unloaded at the first workstation (24). A motor driven drip tray (80) is provided on the adhesive applicator (58) to prevent unintended dripping of adhesive onto mold shells or fixtures. Sensors (122, 124, 125, 130, 132, 137, 142) provide signals to a programmable controller (110) which operates electrical and fluid driven motor components of the apparatus.

24 Claims, 5 Drawing Sheets

METHOD AND APPARATUS FOR BONDING PAIRS OF MOLD SHELLS INTO MOLDS

This invention relates to a method and apparatus for bonding pairs of mold shells into molds, in which an adhesive is applied to one mold shell at a first workstation, the mold shells are assembled and then transferred to a second workstation where the mold shells are pressed together to form the mold.

One type of mold is manufactured by forming a pair of mateable, mold shells which are individually formed using molding techniques in which particulate matter such as sand is combined with a binder and molded into a shell. After the mold shells are formed, they are assembled into a finished mold by applying adhesive between the mating, facing portions of the shells and then pressing the shells together for a period of time sufficient to effectuate a solid bond therebetween. The finished mold may be used to cast various types of parts, such as pumps, camshafts, etc., wherein it is necessary to break up the mold in order to remove the cast parts.

In the past, bonding apparatus has been provided for carrying out the steps of applying adhesive to one of the mold shells and pressing the shells together to complete the bond. Such apparatus includes a first workstation where adhesive is applied to one mold shell and a second workstation which includes a press for pressing the mold shells together after the adhesive has been applied. In carrying out the bonding process using such prior art apparatus, a mold shell was loaded onto a base at a location disposed between the two workstations. The base was pivotally mounted so that it could be swung laterally from the loading position, between the two workstations, to either of the workstations. After the shell was loaded onto the base at the loading position, the base was swung to the first workstation and beneath a stationarily mounted adhesive applicator where a preselected amount of adhesive was applied to selected areas of the first shell. After the application of the adhesive to the first shell, the base was swung back to the loading position where the second shell was assembled onto the first shell. The base was further swung to the second workstation and into contact with a stop which located the assembled mold beneath a press. The press was then cycled to press the mold shells together for a requisite length of time required to create a satisfactory bond. Only after the bonded, assembled mold was removed from the base could the base be swung back to the loading position so that the next shell could be loaded thereon and transferred to the first workstation for the next production cycle.

The prior art method and apparatus described above, while adequate for most applications is subject to improvement in several respects. The use of a single, mold supporting base limited production capacity since it was not possible to perform the preparatory steps of loading a new shell, applying adhesive to it and assembling a second shell until the pressing operation was complete and the previous mold was removed from the base. Further, the use of a pair of bases in the prior art apparatus was not feasible because it would have been necessary to swing the second base to the loading position while the pressing operation was being performed since sufficient clearance did not exist to load a mold shell onto the second base when it was positioned at the first workstation, beneath the stationary adhesive applicator. Further, the fluid adhesive sometimes dripped from the applicator after the adhesive had been applied to a shell, thus creating some waste, contaminating and adhering to various parts of the apparatus and sometimes falling onto portions of a mold where adhesive was not intended to be applied. Finally, problems could occur in achieving proper registration of an assembled mold beneath the press because it was necessary to swing the base into contact with a stop; proper registration was not achieved if the stop became out of adjustment, or if the base was not swung completely into contact with the stop or if the base was swung away from the stop slightly before the pressing operation was commenced. Also, virtually all of the operations mentioned above were carried out in a manual or at best, semi-automatic manner, thus further diminishing production efficiency.

DISCLOSURE OF THE INVENTION

This invention provides a method and apparatus for bonding together a pair of mold shells into a mold, in which adhesive is applied to one of the shells at a first workstation and the assembled shells are pivoted on a base to a second workstation where the shells are pressed together by means of a press. One aspect of the invention is characterized by the use of a base which includes a pair of base portions each suited for supporting a pair of mold shells thereon and means for pivotally mounting the base so that the base portions can be alternately swung between first and second workstations so that the adhesive applying operation and the pressing operation can be simultaneously performed on two molds respectively supported by the base portions. In another aspect, the invention is characterized by a method and apparatus as described above in which the adhesive applicator is shiftably mounted for movement toward and away from the first workstation so that a mold shell can be placed on the base while at the first workstation and so that a second shell can be assembled onto the first shell at the first workstation without the need for moving the base to an intermediate loading position. A further aspect of the invention is characterized by a power operated drip tray mounted for sliding movement on the applicator so as to effectively prevent undesired dripping of the adhesive from the applicator downwardly toward the base and mold shell. Still another aspect of the invention is characterized by the use of means for sensing the movement of the base into a preselected position at the second workstation where it is in proper registration with the press and actuatable locking means for locking the base in such preselected position when sensing means determines that the base has been swung to the preselected position. Finally, a still further aspect of the invention is characterized by a method of bonding pairs of molding shells into a mold in which the adhesive application operation and the pressing operation as performed substantially simultaneously.

Accordingly, it is an advantage of this invention to provide apparatus for bonding pairs of mold shells into a mold that includes a base having a pair of base portions for respectively supporting a pair of mold shells at two workstations where adhesive application and pressing operations are performed respectively.

Another advantage of this invention is to provide a method and apparatus for shifting the adhesive applicator to a standby position to provide access to a mold shell supporting base so that the mold shells can be loaded onto and removed from the base without the need for swinging the base to an intermediate, loading position.

Another advantage of this invention is to provide apparatus as described above which includes a power operated drip tray for preventing unintended dripping of the adhesive from the adhesive applicator.

Another advantage of this invention is to provide apparatus as described above which reliably and repeatedly locates a base and an assembled mold supported thereon in proper registration with the press at the second workstation.

Another advantage of the invention is to provide an apparatus as described above which includes substantially automatic controls that eliminate manual, operator dependent operation and improve production efficiency.

DESCRIPTION OF THE INVENTION

Figure 1:
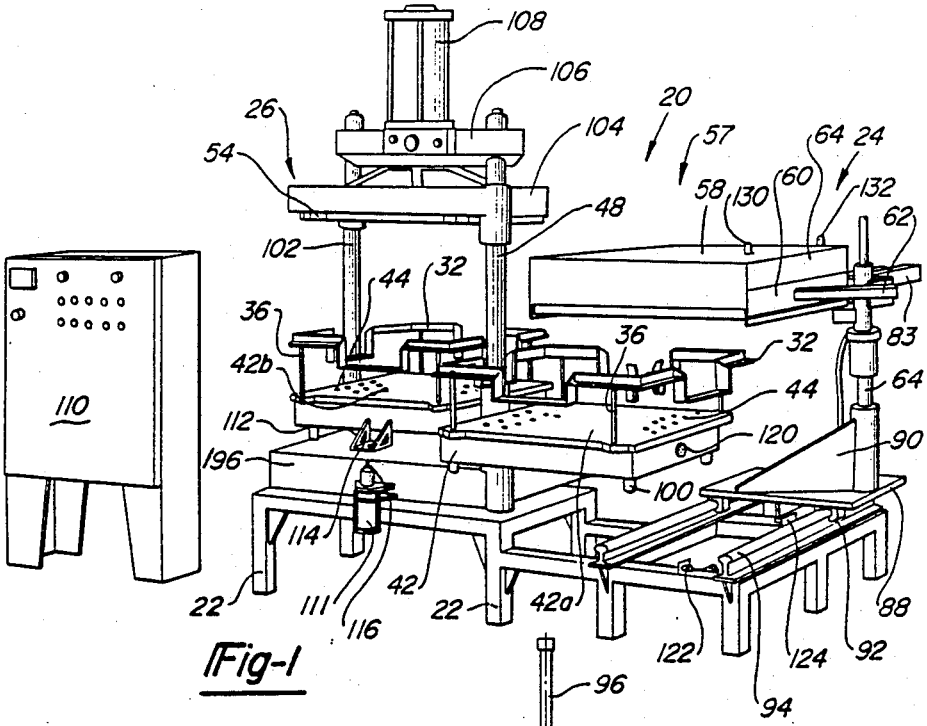
FIG. 1 is a front perspective view of apparatus for bonding pairs of mold shells into a mold, the mold shells not shown for purposes of clarity.

Referring now to the drawings, FIG. 1 illustrates apparatus 20 for bonding pairs of mold shells into a mold. The apparatus 20 broadly includes a first workstation 24, a second workstation 26 and a programmable, electronic controller 110 which may be of the conventional type such as that manufactured by the Allen Bradley Corporation. As will be described below, later discussed mold shells (not shown in FIG. 1) are loaded onto a base 42 and have adhesive applied thereto at the first workstation 24 by means 57 for applying adhesive. After adhesive has been applied to the mold shell and a second shell has been assembled onto the first shell, the assembled mold is rotated along with the base 42 to the second workstation 26 where a press which includes an upper platen 104 presses the mold shells together to complete the bond therebetween.

The base 42 includes first and second portions 42*a*, 42*b* which are secured together by a connector 46 (FIG. 3) which also serves as a bearing which mounts the base 42 onto a column 48 that is supported on framework 22. The base portion 42*a*, 42*b* are thus angularly offset from each other by an amount such that they can be swung to a position where they are respectively disposed at the first and second workstations 24, 26. The base 42 is normally swung in a clockwise direction as viewed in plan. Each of the base portions 42*a*, 42*b* includes an upper surface having a series of holes 44 therein for purposes which will become later apparent. A frame 32 supported by spacers 36 extends around the periphery of the corresponding base portion 42*a* and provides a lateral support for holding a mold shell in proper registration on the base 42. Each of the base portions 42*a*, 42*b* includes a locking bracket 114 on a sidewall thereof, an optical reflector 120 on a second, outer sidewall thereof and force transmitting feet 100 at the corners of the bottom thereof.

The means 57 for applying adhesive located at the first workstation 24 broadly includes an adhesive applicator 58 which is mounted for sliding movement by virtue of guiderails 94, between a first, forward operative positions disposed above base portion 42*a* (and thus a mold shell mounted thereon), and a second standby position, as shown in FIG. 1, providing access to a mold shell on base portion 42*a*. The applicator 58 includes a generally rectangular outer housing 60 having a cover 64 pivotally mounted at the rear thereof. The applicator 56 is mounted by means of a bracket 62 on a column 64 which in turn is secured by a bracket 90 to the upper face of a carriage assembly 88. The carriage assembly 88 is slidably mounted by means of bearings 92 on the guiderails 94. Fore and aft inductive sensors 122, 124 sense the position of the carriage assembly 88 and thus of the applicator 58 along the guiderails 94 and provide position signals to the controller 110.

Means for pressing the mold shells together at the second workstation 26 include a fluid piston 108 mounted on an upper cross piece 106, the cylinder rod of the cylinder 108 being connected with an upper platen 104 which is guided on upright columns 48, 102. The columns 48, 102 are mounted on a base 196 which is in turn supported by the frame 22. A spring pin plate 54 is secured to the lower face of the upper platen 104, the spring pins themselves not being shown in FIG. 1 for purposes of clarity. Mounted on the forward side of the base 196 is an electrically actuatable motor member 111 which has a locking pin 116 aligned with the bracket 114 so as to shift upwardly into an aperture in the bracket 114 and thereby lock the base 42 in a fixed, preselected position such that the base portion 42*a* is aligned in proper registration beneath the applicator 58, and the base portion 42*b* is properly aligned beneath the upper platen 104.

Figure 2:
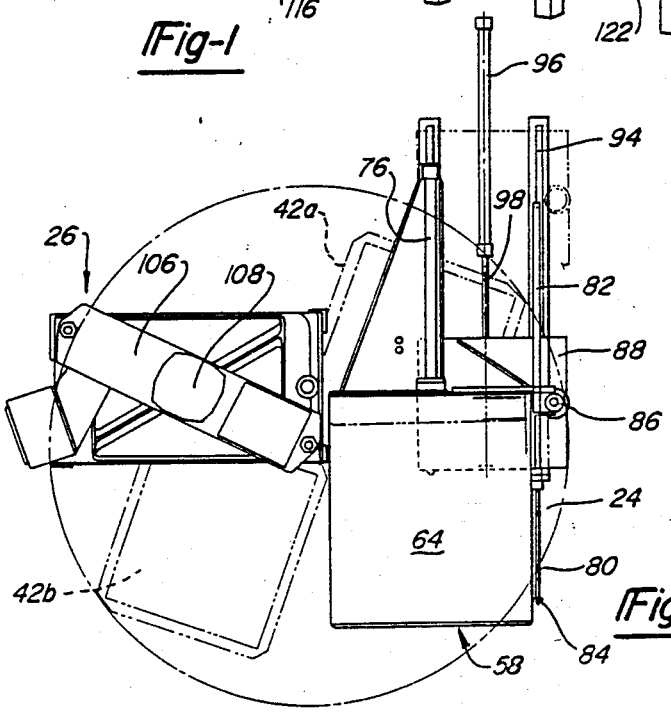
FIG. 2 is a top plan view of the same apparatus.

FIG. 2 depicts the angular relationship between the first and second workstations relative to the rotational path of travel of the base 42, with the base portions 42*a*, 42*b* being indicated in phantom in an intermediate position of rotation in which base portion 42*a* is being swung from workstation 26 to workstation 24 and base portion 42*b* is being swung from workstation 24 to workstation 26. A fluid operated cylinder 76 is mounted on the rear side of the housing 60 and functions to power a later discussed adhesive dispenser. A fluid operated cylinder 96 mounted on the framework 22 includes an output cylinder rod 98 connected with the carriage assembly 88 for driving the latter on the guiderails 94. Fluid operated cylinder 82 mounted on a rearwardly extending bracket 83 (FIG. 1) includes an output 80 secured to a connector 84 for driving a later discussed drip tray. Also shown in FIG. 2 is a screw mechanism 86 for adjusting the height of the applicator 58 on the supporting column 64.

Figure 3:
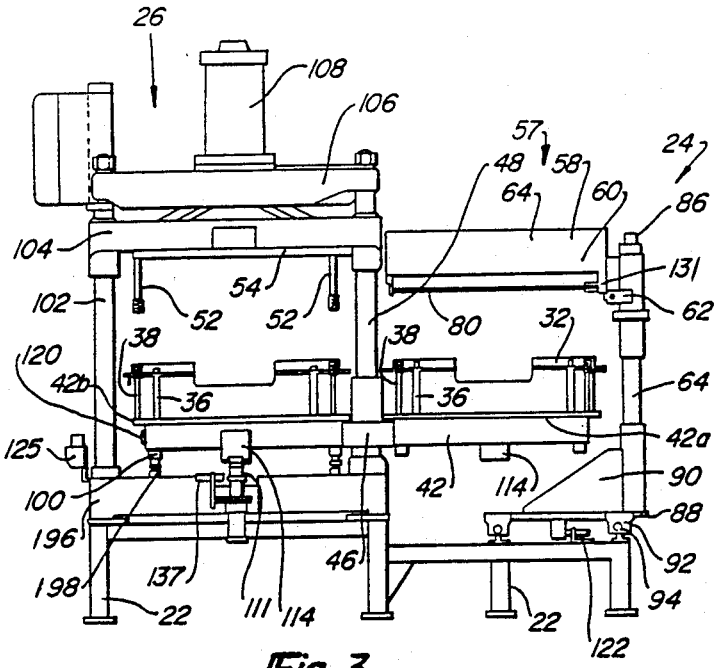
FIG. 3 is a front elevational view of the apparatus.

FIG. 3 is a front elevational view of the apparatus 20 which depicts the drip tray 80 slidably supported on the housing 60 by means of slides 131. Upstanding spring pins 38 are inserted into the apertures 44 (FIG. 1) in the base portions 42*a*, 42*b* and are positioned so as to support selective areas of a mold shell. The spring pins comprise metal rods having compression springs (40) on the upper ends thereof so as to allow some slight degree of vertical movement of the assembled mold shells to accommodate uneveness of the surface of the shells, during the pressing operation. In a similar manner, upper spring pins 52 are mounted in holes in the spring plate 54 at preselected locations so as to engage selected portions of the top portion of the mold. FIG. 3 also depicts a proximity sensor 137, which may be of the inductive or photoelectric type and which is connected to the controller 110 (FIG. 1). The sensor 130 is mounted adjacent the motor member 111 so as to sense the position of the locking pin 116. A photoelectric sensor 125 is mounted on the base 196 and functions to project light onto the reflector 120 and then sense the light reflected therefrom. Upon sensing reflected light, the photoelectric sensor 124 delivers a control signal to the controller 110 indicating that the base portion **42*b* is in proper registration beneath the upper platen 54. Vertically adjustable force transmitting supports 198 are mounted on the upper surface of the base 196, in registration with the feet 100 so as to transmit force from the base portion 42*b* downwardly to the base 196 and frame 22**.

Figure 4:
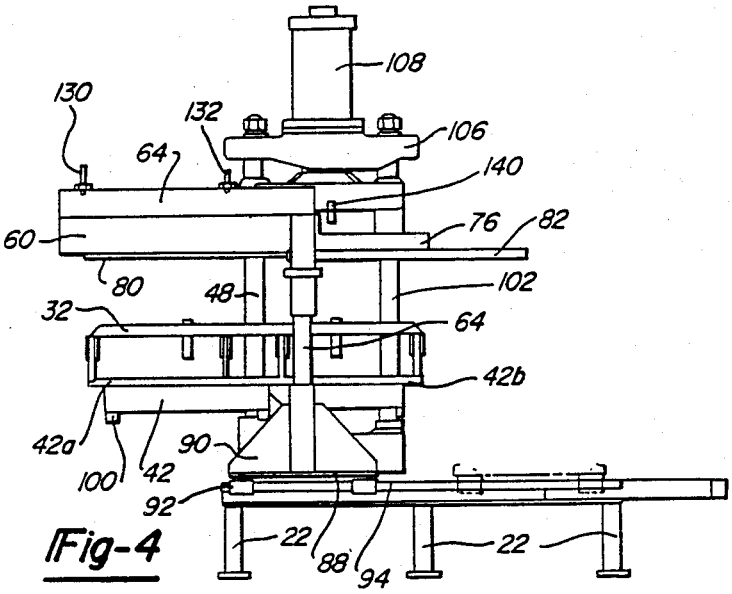
FIG. 4 is a left side elevational view of the apparatus, with the adhesive applicator shown in its forward, operative position.

FIG. 4 is an elevational view of the left side of the apparatus 20 further depicting a proximity sensor 140 of the inductive type which senses the position of the drip tray 80 and delivers position indicating signals to the controller 110. Also shown in FIG. 4, there are a further pair of inductive type sensors 130, 132 mounted in the lid 64 for sensing the position of a later discussed adhesive dispenser.

Figure 5:
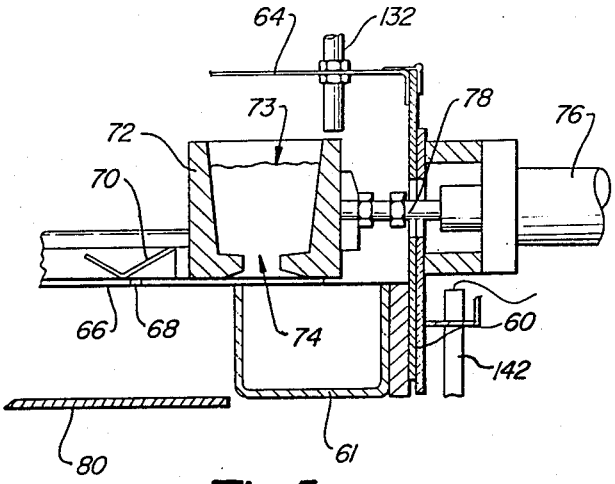
FIG. 5 is a fragmentary, longitudinal sectional view taken through a rear portion of the adhesive applicator, with the drip tray shown in its normal position blocking the flow of dripping adhesive.

FIG. 5 is a longitudinal, sectional view taken through a rear portion of the adhesive applicator 58. The housing 60 includes a rectangular frame 61 around the periphery thereof. Supported on the frame 61 is a template 66, typically of plastic, containing a plurality of apertures 68 therein through which glue may be dispensed downwardly onto selected areas of one of the molds shells. The apertures 68 will thus vary in position corresponding with the particular type of mold being manufactured. The template 66 is held in a fixed horizontal position by means of a plurality of spring clips 70 distributed around the periphery thereof. An elongate adhesive dispenser 72 is disposed on top of the template 66 within the housing 60 and is connected with the cylinder rod 78 of cylinder 76 so as to be linearly displaced along the entire length of the template 66. The adhesive dispenser 62 is elongate and includes an opening 74 in the bottom thereof which extends essentially along the entire length of the dispenser 72, and thus across essentially the entire width of the template 66 so that as the dispenser 72 is displaced by the cylinder 76 adhesive is spread over the surface of the template 66 and is forced through the apertures 68 down onto the selected surface portions of the mold shell. In FIG. 5, the adhesive dispenser 72 is depicted in its normal home position which is detected by the proximity sensor 132. The drip tray 80 in its normal home position beneath the apertures 68 in the template 66. A proximity sensor 142, which may be of the inductive type is mounted on the rear wall of the housing 60 and senses the position of the drip tray 80.

Figure 6:
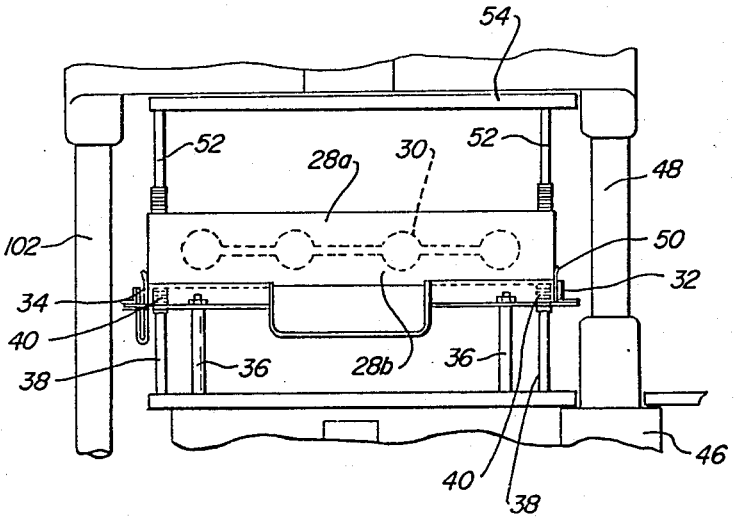
FIG. 6 is an enlarged fragmentary, front view of a portion of the second workstation, depicting a pair of mold shells being pressed together.
Figure 7:
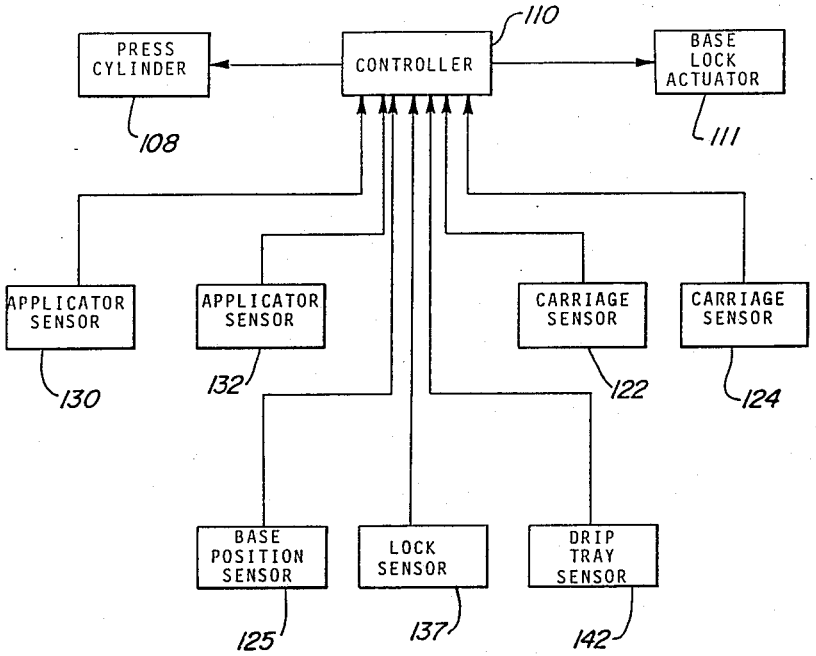
FIG. 7 is a block diagram of inputs to and outputs from the controller.

FIG. 6 is an enlarged front elevational view showing a portion of the press with a pair of assembled mold shells **28*a*, 28*b* being pressed together in a pressing operation. As previously indicated, the lower spring pins 36 and the upper spring pins 52 act in opposite directions against the shells 28*a*, 28*b*, so as to press the latter together at selected points, and particularly at those points where adhesive has been applied to contacting faces of the shells 28*a*, 28*b*. The cavities within the mold thusly formed are indicated in the phantom and are designated by the numeral 30. FIG. 6 further depicts a series of alignment clips 50 along the periphery of the frame 32 which function to properly align the lower mold shell 28*b* in the frame. A spring clip 34 mounted on the frame 32 biases the lower mold shell 28*b* against the clips 50 to prevent shifting of the mold within the frame 32**.

FIG. 6 is a block diagram showing the component parts which are connected with the controller 110, including electrical signal inputs from sensors 122, 124, 125, 130, 132, 137 and 142. Output signals are provided from the controller 110 to the press cylinder 108 and to the base lock actuator 111.

Figure 8:
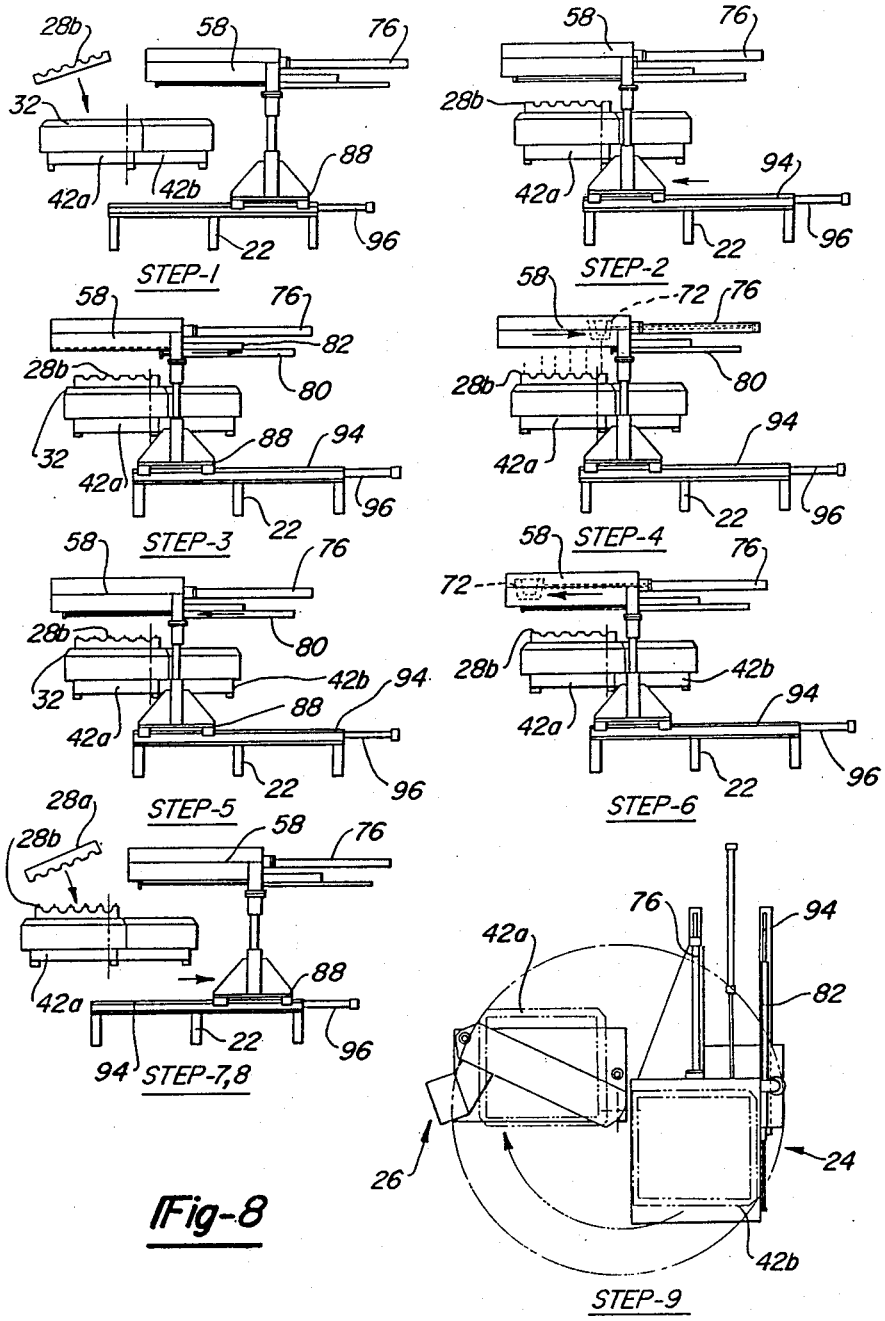
FIG. 8 is a series of diagrammatic views showing the steps of the method.

Attention is now directed to FIG. 8 in combination with FIGS. 1–7, wherein the various steps of the method are depicted. In step 1, adhesive applicator 58 (and carriage 88) is cycled to its rearward, standby position to provide access to the base portion **42*a* which is positioned at the first workstation 26, ready to have the lower mold shell 28*b* loaded thereon. The lower mold shell 28*b* is loaded, either by an operator or by robotic apparatus onto the base portion 42*a*; as the shell is being loaded it engages the clips 50 and spring 34 (FIG. 6) so as to slide downwardly into registration until the lower face thereof engages the springs 40 on spring pins 38. Next, in step 2, the applicator 58 is cycled forwardly to a position such that the template 66 is disposed in overlying registration above the mold shell 28*b*. At this point, in step 3, cylinder 82 is actuated to move the drip tray rearwardly so as to expose the template 66 to the mold shell 28*b***.

As shown in step 4, with fluid adhesive 73 loaded into the dispenser 72, the controller 110 actuates cylinder 76 to drive the dispenser forwardly across the template 66 so as to force a preselected quantity of adhesive through the apertures 68 down onto the selected portions of the mold shell **28*b*. By virtue of the bottom contour of the dispenser 76, a squeegee-like action is provided in which a quantity of the adhesive is actually forced through the apertures 68. Next, in step 5, cylinder 82 is actuated again to move the drip tray 80 back to its home position, covering the template 66 so that any remaining adhesive which may drip through the apertures 68 is caught by the tray 80 rather than being dripped onto other portions of the apparatus or portions of the mold shells where adhesive should not be applied. It should be noted here, that in step 4, the dispenser 72 may be cycled across the template 66 one or more strokes, e.g., it may be extended and retracted to form two complete strokes, if desired. In step 6, the dispenser 72 may be again displaced to clear the template 66 of any residue adhesive, which is then forced through the aperture 68 down onto the drip plate 80. Next, cylinder 96 is actuated by the controller 110 and the carriage 88 is moved rearwardly along the guiderails 94 so as to displace the adhesive applicator 58 rearwardly, thereby providing the operator or robotic mechanism access to the lower mold shell 28*b*. At this point, the operator or robotic mechanism assembles the upper mold shell 28*a* on top of the lower mold shell 28*b* while the base portion 42*a* remains at the first operating station 24**.

The base 42 is then manually swung in a counterclockwise direction, as shown in step 9 (FIG. 8) until base portion **42*a*, is positioned in proper registration at the second workstation 26, and base portion 42*b* is properly positioned in registration at the first workstation 24. When base portion 42a reaches its proper position in the second workstation 26, the photosensor 125 transmits a signal to the controller 110 which in turn actuates the locking motor 111 so that the locking pin 116 shifts upwardly into the locking bracket 114, thereby locking the entire base 42** in proper position for the next operation.

With the base portion 42a properly positioned and locked in place at the second workstation 26a, the controller 110 then actuates cylinder 108 to cause upper platen 104 to descend so that the mold shells 28a, 28b are pressed together by the upper and lower spring pins 52, 38. The press cylinder 108 remains cycled to maintain the pressing operation for a time period selected by the controller 110.

After the base 42 is locked in position as described above so that the pressing operation can commence at the second workstation 26, the operator or robotic mechanism may load another mold shell of a second mold onto the base portion 42b which is disposed at the first workstation 24, and steps 2 through 8, as shown in FIG. 8 can be carried out while the pressing operation is performed at workstation 26. It is thus apparent that the adhesive applying operation and the pressing operation may be essentially simultaneously carried out in connection with two molds. After the mold on base portion 42a has been pressed the requisite length of time, the cylinder 108 is cycled to raise the upper platen 104 and, assuming that the adhesive operation has been completed at the first workstation 24 and the upper mold shell has been assembled onto the lower mold shell as this station, the operator may then again swing the base 42 clockwise so as to reposition the base portion 42a at the first workstation 24 and reposition the base portion 42b at the workstation 26. Again, the base 42 is then locked in place by the locking mechanism 111, and at this point the operator or robotic mechanism may remove the finished mold from the base portion 42a at workstation 24 and replace it with a fresh lower mold shell so that the entire process may be repeated.

We claim:

1. Apparatus for bonding a pair of mold shells (28a, 28b) into a mold, characterized by:

a base (42) upon which one of said mold shells (28b) can be supported;

a frame (22);

means (46, 48) for pivotally mounting said base (42) on said frame (22) whereby said mold shells (28a, 28b) may be pivoted about an axis between first and second workstations (24, 26);

means (57) at said first workstation (24) for applying an adhesive to said one mold shell (28b), said adhesive applying means (58) including (1) an adhesive applicator (58) including a supply (73) of said adhesive for dispensing said adhesive from said supply thereof onto said one mold shell (28b), and (2) means (62, 62, 90, 88, 92, 94) for mounting said applicator (58) for shifting movement between a standby position spaced from said first workstation (24) to allow said mold shells to be placed onto said base (42), and an operative position at said first workstation (24) disposed over said one mold shell (28b) on said base (42), (3) controllable motor means (96) coupled with said applicator (58) for shifting said applicator (58) between said standby position and said operative position;

control means (110) for controlling the operation of said motor means (76); and means (54, 104, 108) at said second workstation (26) for pressing said mold shells (28a, 28b) together after said base (42) is pivoted from said first workstation (24) to said second workstation (26).

2. The apparatus of claim 1, wherein said adhesive applying means (57) includes a drip tray (80) shiftably mounted on said applicator (58) for shifting movement between a first position disposed beneath said applicator in which said drip tray catches adhesive dripping from said applicator and a second position in laterally clearing relationship to said applicator during the application of said adhesive to said first mold shell (28b).

3. The apparatus of claim 2, wherein said adhesive applying means (57) includes a motor member (76) controlled by said control means (110) for shifting said drip tray (80) between said first and second positions thereof.

4. The apparatus of claim 2, wherein said drip tray (80) is shiftably mounted on said applicator by a slide (131).

5. The apparatus of claim 1, wherein said base (42) includes a pair of base portions (42a, 42b) angularly offset from each other about said axis, each of said base portions (42a, 42b) including means (38) for supporting a pair of said mold shells thereon, and wherein said base portions are normally respectively disposed at said first and second workstations, whereby adhesive may be applied to one mold shell of a first pair thereof at said first workstation substantially simultaneously with the pressing together of a second pair of said mold shells at said second workstation.

6. The apparatus of claim 5, including means (125) for sensing the movment of one of said base portions into a preselected position at one of said first and second workstations, and power operated means (111) responsive to said control means (110) for releasably locking said base (42) against pivotal movement upon sensing one of said base portions at said preselected position.

7. The apparatus of claim 6, wherein said releasable locking means (111) includes first and second interlocking portions (114, 116) respectively mounted on said base and said frame.

8. The apparatus of claim 5, wherein said pair of base portions are pivotable in an essentially horizontal plane about said axis.

9. The apparatus of claim 1, wherein said mounting means includes a carriage (88) upon which said applicator (58) is mounted, and guide means (94) on said frame (22), said carriage (88) being mounted for movement along said guide means (94).

10. Apparatus for bonding together a pair of mold shells (28a, 28b) into a mold, characterized by:

a first workstation (24) including means (58) for applying an adhesive to one shell (28b) of a first pair of said shells (28a, 28b);

a second workstation (26) spaced from said first workstation (24), and including means (54, 104, 108) pressing together a second pair of said shells after adhesive has been applied to one shell in said second pair thereof at said first workstation (24);

a base (42) including a pair of spaced apart, connected base portions (42a, 42b) for respectively supporting said one shell in said first and second pairs thereof, and wherein one of said base portions is normally positioned at said first workstation and the other of said base portions is normally positioned at said second workstation; and means (46, 48) for pivotally mounting said base (42) about an essentially vertical axis such that said base portions can be swung between said first and second workstations so that when a shell supported on one of said base portions at said first workstation to which adhesive has been applied is swung to said second workstation the base portion at said second workstation is simultaneously swung to said first workstation.

11. The apparatus of claim 10, wherein said pivotal mounting means includes an upright member (48), and a bearing portion (46) rotatably mounted on said upright member, said base portions being secured to and extending laterally away from said bearing portion.

12. The apparatus of claim 10, wherein said second workstation includes a frame (22) and said apparatus further includes releasable locking means (111, 116, 114) for locking said base with said frame to selectively prevent said base from pivoting about said axis.

13. The apparatus of claim 12, wherein said apparatus includes:

means (125) at said second workstation for sensing when one of said base portions has been swung into a preselected position within said pressing means; and control means (110) coupled with said sensing means and responsive to said sensing means for controlling said releasable locking means.

14. The apparatus of claim 12, wherein said apparatus further includes frame means (22), and a controller (110), and said locking means includes:

an actuatable locking member (116) mounted on said frame means (22) and actuatable by said controller, and a lockable member (114) mounted on said base and cooperating with said locking member to prevent pivoting of said base.

15. The apparatus of claim 10, wherein said applying means includes an adhesive applicator (58) including a supply (73) of adhesive for dispensing said adhesive from said supply thereof onto said one shell and means (62, 64, 90, 88, 92, 92) for mounting said applicator (58) for shifting movement between a standby position spaced from said workstation to allow said one mold shell to be placed on one of said base portions positioned at said first workstation, and an operative position at said first workstation disposed over said one mold shell.

16. The apparatus of claim 15, wherein said applying means includes motor means (96) coupled with said mounting means (62, 64, 90, 88, 92, 94) for shifting said applicator (58) between said standby position and said operative position.

17. The apparatus of claim 15, wherein said applying means includes a motor operated drip tray (80) mounted on said applicator for shifting movement between a normal, closed position preventing dripping of said adhesive from said applicator and an operated, open position allowing said adhesive to be dispensed from said applicator onto said one shell.

18. In apparatus for bonding a pair of mold shells (28*a*, 28*b*) into a mold, and of the type including means (38, 42) for supporting a mold shell thereon, means (46, 48) for mounting said supporting means for swinging movement between a first workstation (24) where an adhesive is applied to said one shell and a second workstation (26) wherein said pair of mold shells are pressed together, an adhesive applicator (58) for dispensing an adhesive downwardly onto said one mold shell, and a press (54, 104, 106, 108) at said second workstation (26) for pressing said shells together, the improvement characterized by:

drip tray means (80, 130, 82) mounted on said applicator (58) for shifting movement between a first, closed position beneath said applicator in which said tray receives adhesive dripped from said applicator and a second, open position laterally spaced from said first position.

19. The improvement of claim 18, wherein said drip tray means includes:

a drip tray (80), means (131) for slidably mounting said tray on said applicator, and motor means (82) coupled with said tray for sliding said tray between said first and second positions.

20. In apparatus for bonding a pair of mold shells (28*a*, 28*b*) into a mold, and of the type including means (38, 42) for supporting a mold shell (28*b*) thereon, means (46, 48) for mounting said supporting means for swinging movement between a first workstation (24) where an adhesive is applied to said one shell and a second workstation (26) where said pair of mold shells are pressed together, an adhesive applicator (58) for dispensing adhesive onto said one mold shell, and a press (54, 104, 106, 108) at said second workstation (26) for pressing said shells together, the improvement comprising:

means (125) for sensing the swinging of said support (42, 38) from said first workstation (24) to a preselected position beneath said press at said second workstation (26) and for producing an electrical signal upon sensing said support at said preselected position;

actuatable locking means (111, 114, 116) for releasably locking said support in said preselected position; and control means (110) coupled with said sensing means and said locking means and responsive to said signal for actuating said locking means.

21. The improvement of claim 20, wherein said locking means includes a lockable member (114) secured on said support, and an electrically responsive locking element (116) shiftable into engagement with said lockable member.

22. A method of bonding pairs of mold shells (28*a*, 28*b*) into a mold, characterized by:

(A) loading one mold shell (28*b*) of a first pair thereof onto a first support (42*a*) at a first workstation (24);

(B) applying adhesive to said one mold shell (28*b*) while said one mold shell (28*b*) is on said first support (42*a*) at said first workstation (24);

(C) assembling a second mold shell (28*a*) onto said first mold shell (28*b*) of said first pair thereof after step (B) is completed and while said first support is at said first workstation (24);

(D) swinging said first support (42*a*) with the assembled first pair of mold shells thereon laterally to a second workstation (26) and simultaneously swinging a second support (42*b*) from said second workstation (26) to said first workstation (24);

(E) pressing together said first pair of mold shells at said second workstation (26) after step (D) is completed; and (F) loading one mold shell of a second pair thereof onto second support (42*b*) at said first workstation (24) while said first pair of mold shells is on said first support (42*a*) at said second workstation (26).

23. The method of claim 22, including the steps of (G) applying adhesive to said one mold shell in said second pair thereof while said one mold shell in said second pair thereof is on said second support (42*b*) at said first workstation (24), steps (E) and (G) being performed substantially during the same period of time.

24. The method of claim 23, including the steps of:

(H) removing said first pair of mold shells from said first support at said second workstation (26);

(I) assembling a second mold shell onto said first mold shell of said second pair thereof;

and then, after steps (H) and (I) are completed, (J) swinging said second support with said second pair of mold shells thereon from said first workstation (24) to said second workstation (26) and simultaneously swinging said first support from said second workstation (26) to said first workstation (24).

* * * * *